US006386681B1

(12) United States Patent
Askren et al.

(10) Patent No.: US 6,386,681 B1
(45) Date of Patent: May 14, 2002

(54) CARRIER ASSEMBLY AND INK JET PRINTHEAD ASSEMBLY ASSOCIATED THEREWITH

(75) Inventors: Benjamin Alan Askren, Lexington; John Edward Borsuk, Nicholasville; Larry Steven Foster, Lexington; Frank Marion Hughes, Paris; Darren Wayne Tosh, Lexington, all of KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/496,089

(22) Filed: Feb. 1, 2000

(51) Int. Cl.[7] ..... B41J 2/01
(52) U.S. Cl. ..... 347/49
(58) Field of Search ..... 347/85, 86, 87, 347/49, 50, 37, 39

(56) References Cited

U.S. PATENT DOCUMENTS 4,709,247 A 11/1987 Piatt et al.
4,872,026 A 10/1989 Rasmussen et al.
5,467,116 A 11/1995 Nakamura et al.
5,539,436 A 7/1996 Wilson et al.
5,600,350 A * 2/1997 Cobbs et al. ..... 347/19
6,064,416 A * 5/2000 Esch et al. ..... 347/225

* cited by examiner

*Primary Examiner*—N. Le
*Assistant Examiner*—Michael Nghiem
(74) *Attorney, Agent, or Firm*—D. Brent Lambert; Todd T. Taylor

(57) ABSTRACT

The printhead unit is for an imaging apparatus having a guide member. The printhead unit is configured to be positioned in a carrier assembly within the imaging apparatus and is configured for movement within the imaging apparatus via the carrier assembly. The printhead unit includes a housing a printhead and at least one bearing. The housing has at least a first side member. The printhead is attached at least to the first side member of the housing. Further, the at least one bearing has at least one bearing surface, the at least one bearing being coupled to the first side member of the housing and positioned to engage the guide member.

36 Claims, 3 Drawing Sheets

CARRIER ASSEMBLY AND INK JET PRINTHEAD ASSEMBLY ASSOCIATED THEREWITH

BACKGROUND OF THE INVENTION

1. Field of the Invention

The present invention relates to an ink jet printer, and more particularly, to an ink jet printhead carrier and one or more ink jet printhead assemblies associated therewith.

2. Description of the Related Art

Typical ink jet printers include a printer frame which defines a media path for a sheet of media. A sheet of print media is transported by a series of rollers along the media path through a print zone. In the print zone, one or more printheads eject ink onto the sheet at predefined locations to form an image thereon. The quality of the formed image is dependent, at least in part, on the tolerances and alignment of various components in the printing system.

Such a typical ink jet printer includes a printhead carrier for carrying the one or more printheads. The ink jet printer also includes one or more guide rods mounted to the printer to be positioned transverse to the direction of media travel. The guide rods guide the printhead carrier for reciprocating movement across the width of the sheet of print media. Typically, each printhead is mounted into a cradle within the printhead carrier. The carrier includes fixed bearings which contact a guide surface of each of the one or more guide rods.

Although this approach can provide adequate printing results, such an arrangement induces positioning and alignment errors between the physical location of the print nozzles of the printhead in relation to the position of the printhead carrier, and in relation to the one or more guide rods which position and support the printhead carrier. Such positioning and alignment errors translate into errors between the calculated location on the sheet of print media at which an ink dot is to be placed and the actual location at which the ink dot is placed, which in turn translates into decrease print quality.

SUMMARY OF THE INVENTION

In one aspect of the invention, an imaging apparatus includes a first side frame and a second side frame. A first guide rod extends between the first side wall and the second side wall and has a first surface and a first cross-sectional area. A second guide rod extends between the first side frame and the second side frame and is arranged parallel to the first guide rod. The second guide rod has a second surface and a second cross-sectional area. The imaging apparatus also includes a carrier assembly having a body, and a printhead interface unit attached to the body. A printhead unit is structured and adapted for mating engagement the printhead interface unit. The printhead unit has at least one bearing surface which contacts the first surface of the first guide rod and at least one second bearing surface which contacts the second surface of the second guide rod.

In another aspect of the invention, an imaging apparatus includes a first side frame and a second side frame. A first guide rod extends between the first side wall and the second side wall, wherein the first guide rod has a first surface and a first cross-sectional area. A second guide rod extends between the first side frame and the second side frame and is arranged parallel to the first guide rod. The second guide rod has a second surface and a second cross-sectional area. The imaging apparatus also includes a carrier assembly having a body, and a color printhead interface unit attached to the body. A color printhead unit is structured and arranged for mating engagement with the color printhead interface unit. The color printhead unit has a first bearing surface which contacts the first surface of the first guide rod and a first pair of V-shaped bearings defining four bearing surfaces which contact the second guide surface of the second guide rod.

Another aspect of the invention is a printhead unit for an imaging apparatus having a guide member. The printhead unit includes a housing, a printhead attached to the housing and at least one bearing having at least one bearing surface. The bearing is coupled to the housing and is positioned to engage the guide member.

Another aspect of the invention provides a printhead unit for an imaging apparatus having a first guide member and a second guide member. The printhead unit includes a housing; a printhead attached to the housing; a first bearing having a first bearing surface, the first bearing being coupled to the housing and positioned to engage the first guide member; and a second bearing having a second bearing surface, the second bearing being coupled to the housing and positioned to engage the second guide member.

An advantage of the present invention is that the carrier assembly is positioned relative to at least one printhead unit, thereby reducing positioning and alignment errors between the printhead unit and the carrier assembly.

Another advantage of the invention is that each printhead unit is directly positioned relative to the guide rod(s) of the imaging apparatus by locating guide rod bearings on each printhead unit, thereby eliminating the carrier as a factor in positioning and alignment errors between the printhead unit and the guide rod(s).

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
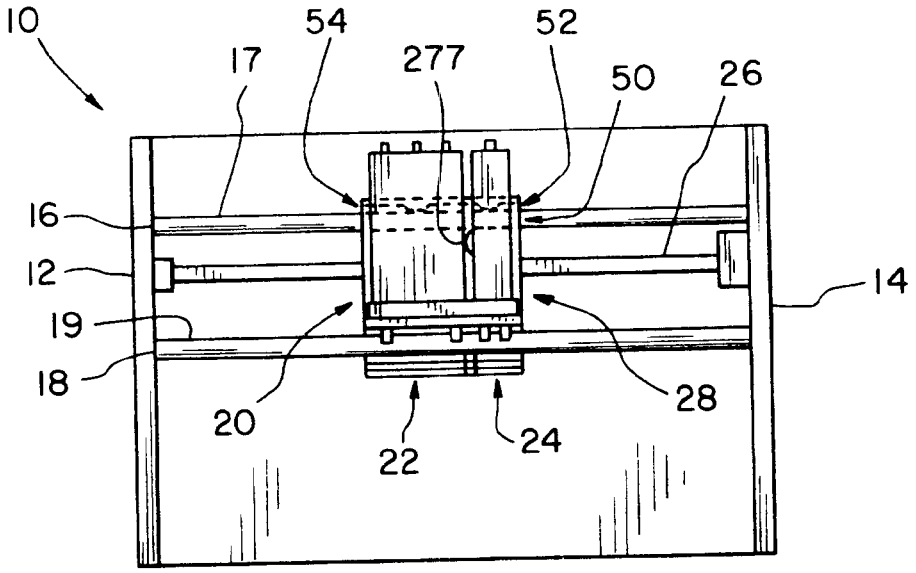
FIG. 1 is a schematic illustration of an imaging apparatus embodying the present invention.

Referring now to the drawings and particularly to FIG. 1, there is shown an imaging apparatus 10, such as an ink jet printer, embodying the present invention. Imaging apparatus 10 includes a first side frame 12, a second side frame 14, a first guide rod 16, a second guide rod 18, a carrier assembly 20, a color printhead assembly 22, a mono (e.g., black) printhead assembly 24 and a drive belt 26. As used hereinafter, positional terms such as for example, left, right, top, bottom, upper, lower, back front, etc., are used to aid the reader in understanding the invention as depicted in the various FIGS., and should not be considered terminology which limits the scope of the invention.

First guide rod 16 is attached to and extends between first side frame 12 and second side frame 14. Preferably, first guide rod 16 is circular in cross-section and has a diameter of about 8 millimeters (mm). Also, first guide rod 16 has a smooth cylindrical surface 17. Second guide rod 18 is attached to and extends between first side frame 12 and second side frame 14. Preferably, second guide rod 18 is circular in cross-section and has a diameter of about 12 mm. Second guide rod 18 has a smooth cylindrical surface 19.

Figure 5:
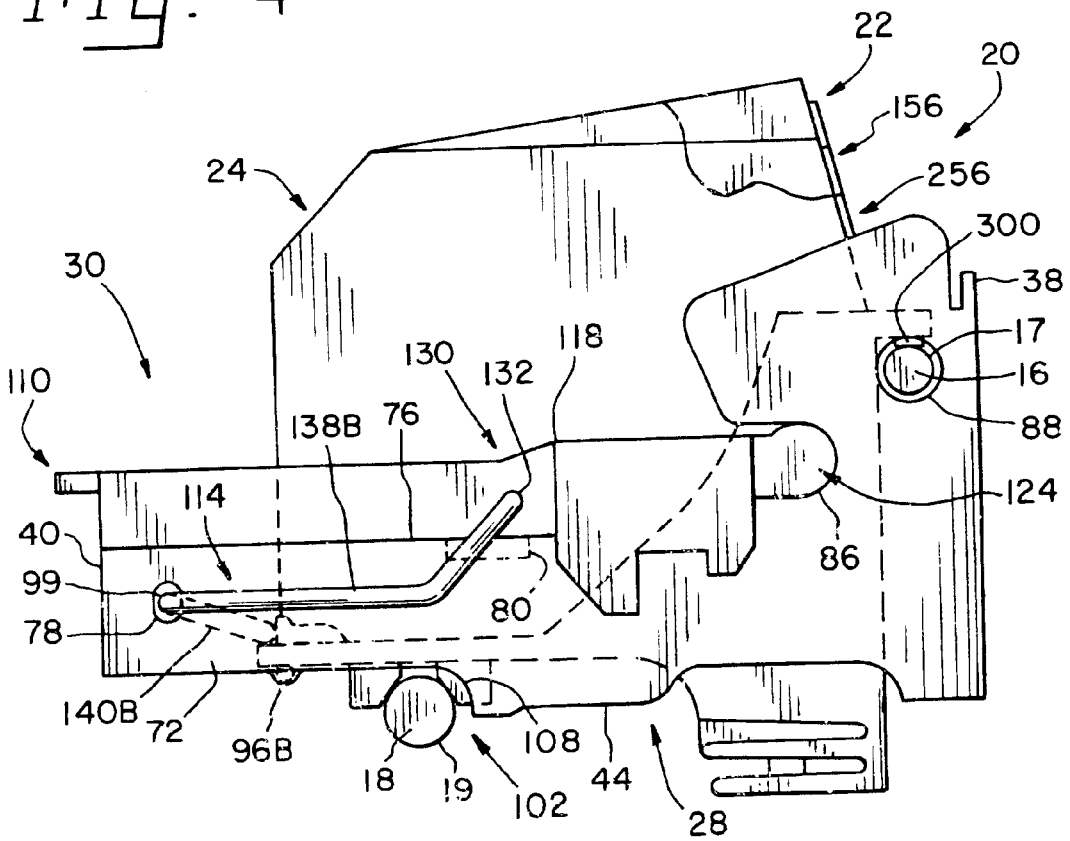
FIG. 5 is a side view of the carrier assembly and the printhead assemblies of the present invention with the carrier assembly secured to the printhead assemblies of the present invention.

As can be best seen in FIG. 5, in relation to FIG. 1, first guide rod 16 is positioned to have both a vertical offset and a horizontal offset in relation to second guide rod 18. In FIG. 5, a portion of mono printhead assembly 24 is broken away to expose a portion of color printhead assembly 22. In the component orientation shown in FIG. 5, first guide rod 16 is positioned generally in front of printhead assemblies 22 24, and second guide rod 18 is positioned to be beneath printhead assemblies 22, 24, and beneath carrier assembly 20. When printhead assemblies 22, 24 are not mounted in imaging apparatus 10, carrier assembly 20 is loosely mounted in imaging apparatus 10 via first guide rod 16, and rests by the effects of gravity on first guide rod 16 and second guide rod 18.

Figure 2:
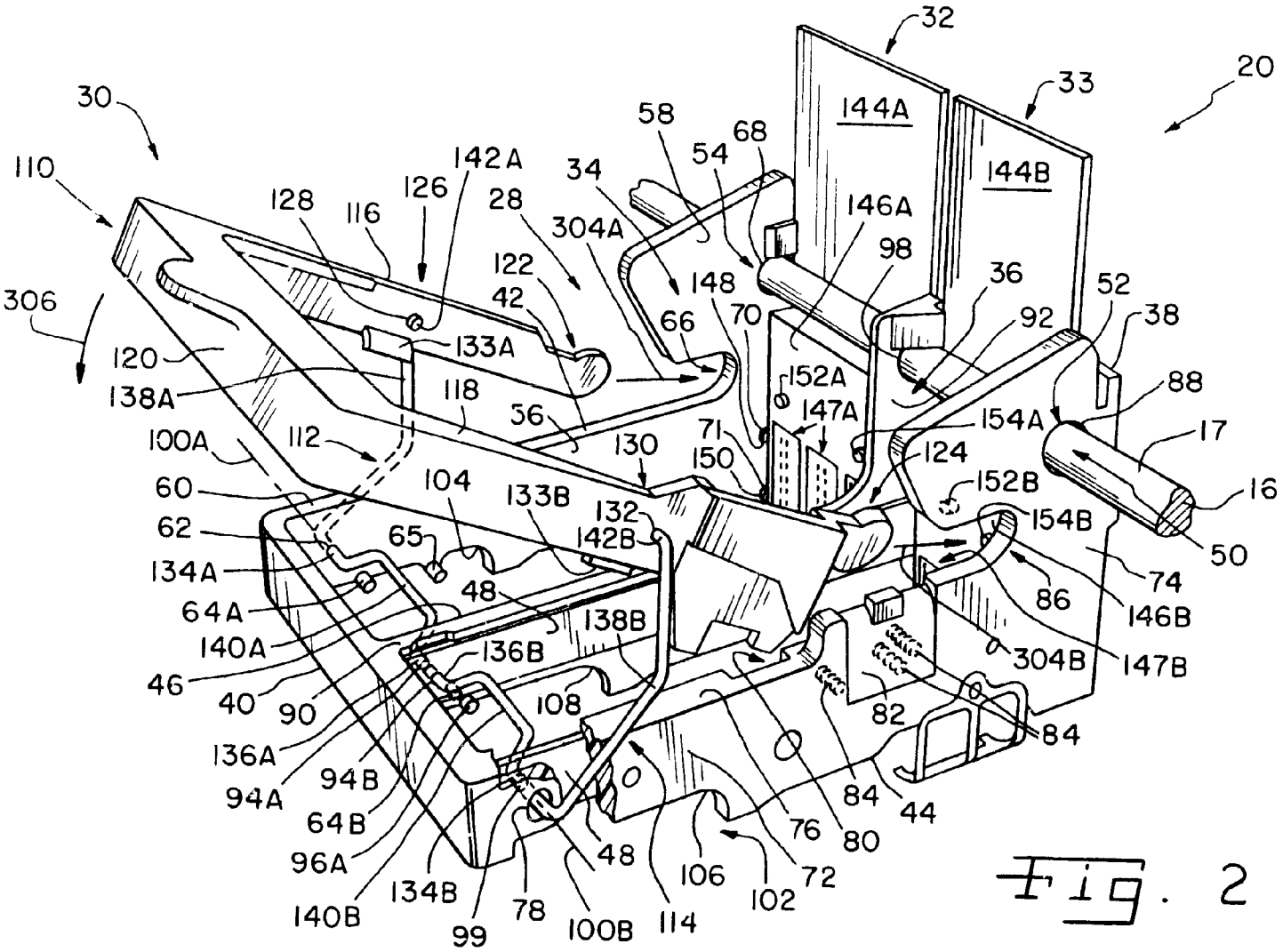
FIG. 2 is a perspective view of a carrier assembly of the present invention.

Referring now to FIG. 2, carrier assembly 20 includes a body 28, a latching mechanism 30, a color card assembly 32 and a mono card assembly 33.

Body 28 defines a color receptacle 34 for mounting color printhead assembly 22 and a mono receptacle 36 for mounting mono printhead assembly 24. Body 28 includes a front wall 38, a back wall 40, a side wall 42, an opposing side wall 44 and a middle side wall 46. Front wall 38, back wall 40, and side walls 42, 44 are arranged to form a substantially rectangular structure. Middle side wall 46 is located within body 28 to define the general size of each of color receptacle 34 and mono receptacle 36. Thus, color receptacle 34 is defined, in part, by walls 38, 40, 42, 46, and mono receptacle 36 is generally defined, in part, by walls 38, 40, 44 and 46. However, mono receptacle 36 includes an inner frame 48 which is mechanically coupled to front wall 38, and loosely coupled to side frame 44, as will be further described below, to facilitate alignment of mono printhead assembly 24 independent of the alignment of color printhead assembly 22. Body 28 includes a passage 50 having a first opening 52 and a second opening 54 for loosely receiving first guide rod 16.

Side wall 42 includes a base portion 56 and an extension portion 58 which extends upwardly from base portion 56. Base portion 56 includes a surface 60, an axle hole 62, a carrier stop member 64A and a spacing boss 65. Extension portion 58 includes a pivot slot 66, a passage hole 68, a first locator (index) indention 70 and a second locator indention 71.

Opposing side wall 44 includes a base portion 72 and an extension portion 74 which extends upwardly from base portion 72. Base portion 72 includes a surface 76, an axle slot 78, a guide slot 80, and a door 82 which actuates a plurality of biasing springs 84. Guide slot 80 extends generally perpendicularly downward from surface 76 into base portion 72. Second extension portion 74 includes a pivot slot 86 and a passage hole 88.

Middle side wall 46 includes a base portion 90 and an extension portion 92 which extends upwardly from base portion 90. Base portion 90 includes an axle hole 94A facing color receptacle 34 and a carrier stop member 64B which faces color receptacle 34. Middle extension portion 92 includes a passage hole 98.

Referring to FIG. 2, inner frame 48 is a generally rectangular structure and includes an axle hold 94B located near middle side wall 46, and an axle hole 99 which is located on an opposing wall of rectangular inner frame 48. Axle hole 99 is positioned to be generally in alignment with a portion of axle slot 78 of side wall 44. Inner frame 48 further includes a pair of carrier stop members 96A, 96B (see FIGS. 2 and 5) which are positioned on opposing side walls of the rectangular structure of inner frame 48.

As shown in FIG. 2, passage 50 includes passage holes 68, 88 and 98 of side walls 42, 44 and 46, respectively. Passage holes 68, 88, 98 have a cross-sectional area larger than the cross-sectional area of guide rod 16 so as to enable carrier assembly 20 to be positioned such that guide rod 16 is not contacted by carrier assembly 20. As shown, passage holes 68, 88, 98 are located near front wall 38 of body 28.

Axle holes 62, 94A are arranged in body 28 to be coaxial with respect to an axis 100A, and axle holes 94B, 99 are arranged in inner frame 48 to be coaxial with axis 100B. Axle holes 62, 94A, 94B and 99 are arranged to be near back wall 40 of body 28. Body 28 further defines a recessed region 102 defined by arc surfaces 104, 106, 108 formed on the under side of base portions 56, 72, 90 of side walls 42, 44, 46, respectively. Recessed region 102 is located to accommodate guide rod 18.

Alternatively, inner frame 48 can be made integral with the walls defining mono receptacle 36. In such a case, axle hole 94B and carrier stop 96A would become a part of middle side wall 46, and axle hole 99 and carrier stop 96B would become part of side wall 44. However, in such an arrangement, the ability to independently align color printhead assembly 22 and mono printhead assembly 24 would be diminished.

Latching mechanism 30 is structured and adapted for pivotal mounting to body 28. Latching mechanism 30 includes a U-shaped handle 110, a color bail 112 and a mono bail 114.

U-shaped handle 110 is defined by a first member 116 and a second member 118 which are spaced apart and extend in parallel from a bridge member 120. First member 116 has a first distal end 122 for engaging pivot slot 66 of body 28, and second member 118 has a second distal end 124 for engaging pivot slot 86 of body 28. First member 116 has a mid-portion 126 having a pivot hole 128 formed therein. Second member 118 has mid-portion 130 having a pivot hole 132 formed therein. Located near pivot hole 128 is a downwardly extending guide member 133A which is positioned to engage a slot (not shown) located near surface 60 of side wall 47. Located near pivot hole 132 is downwardly extending guide member 133B which is positioned and sized for mating engagement with guide slot 80.

Color bail 112 has a first axle portion 134A, a second axle portion 136A, a lever portion 138A and a latching portion 140A. First axle portion 134A is spaced apart and coaxial with second axle portion 136A along axis 100A. Latching portion 140A is formed between and extends outwardly away from first axle portion 134A and second axle portion 136A. First axle portion 134A is positioned in axle hole 62 of body 28 and second axle portion 136A is positioned in axle hole 94A of body 28.

Likewise, mono bail 114 has a first axle portion 134B, a second axle portion 136B, a lever portion 138B and a latching portion 140B. First axle portion 134B is spaced apart and coaxial with second axle portion 136B along axis 100B. Latching portion 140B is formed between and extends outwardly away from first axle portion 134B and second axle portion 136B. First axle portion 134B is positioned in axle hole 99 of inner frame 48 and second axle portion 136A is positioned in axle hole 94B of inner frame 48.

Each of the lever portions 138A, 138B extend outwardly away from axes 100A, 100B, respectively. Lever portion 138A of color bail 112 has an extended end defining a pivot portion 142A positioned for engaging pivot hole 128 of handle 110. The extent of lever portion 138A from axis 100A is selected to be greater than an extent of latching portion 140A from axis 100A. Likewise, lever portion 138B of mono bail 114 has an extended end defining a pivot portion 142B positioned for engaging pivot hole 132 of handle 110. The extent of lever portion 138B from axis 100B is selected to be greater than an extend of latching portion 140B from axis 100B. Preferably, the extents of lever portions 138A and 138B are substantially equal. Each of lever portions 138A, 138B have an angular shape, which is commonly referred to as a "dog leg" shape.

Color card assembly 32 provides both electrical and mechanical connection to color printhead assembly 22. Color card assembly 32 is attached to front wall 38 of carrier assembly 20. Color card assembly 22 includes a color circuit card 144A and a color printhead interface assembly 146A. Color circuit card 144A includes electrical connectors and printed circuits (not shown) which facilitates electrical communication between the printer controller (not shown) of imaging apparatus 10 and color printhead interface assembly 146A. Color circuit car 144A also includes a pair of locator pins 148, 150 which are sized and positioned for mating engagement with corresponding locator indentions 70, 71, respectively, of side wall 42 in color receptacle 34.

Color printhead interface assembly 146A is electrically and mechanically connected to color circuit card 144A. Color printhead interface assembly 146A (commonly referred to as a pogo pin assembly) includes a plurality of spring-loaded pin conductors 147A which provide positive electrical connection to the electrical circuits of the color printheads of color printhead assembly 22. Color printhead interface assembly 146A further includes a pair of alignment bosses 152A, 154A.

Mono card assembly 33 provides electrical connection to mono printhead assembly 24, and accommodates mechanical alignment of mono printhead assembly 24 therewith. In preferred embodiments, mono card assembly 33 is attached to inner frame 48 prior to attachment to front wall 38. Mono card assembly 33 includes a mono circuit card 144B and a mono printhead interface assembly 146B. Mono circuit card 144B includes electrical connectors and printed circuits (not shown) which facilitates electrical communication between the printer controller (not shown) of imaging apparatus 10 and mono printhead interface assembly 146B.

Mono printhead interface assembly 146B is electrically and mechanically connected to mono circuit card 144B. Mono printhead interface assembly 146B (e.g., a pogo pin assembly) includes a plurality of spring-loaded pin conductors 147B which provide positive electrical connection to the electrical circuits of the mono printhead of mono printhead assembly 24. Mono printhead interface assembly 146B further includes a pair of alignment bosses 152B, 154B.

Figure 3:
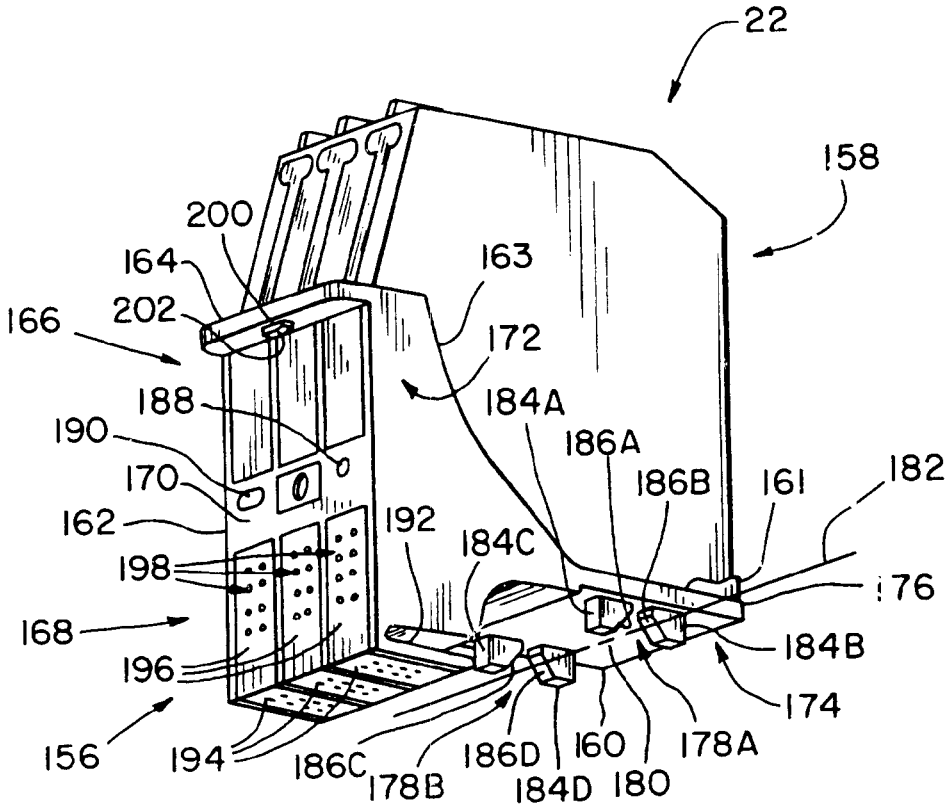
FIG. 3 is a perspective view of a color printhead assembly of the present invention.

Referring now to FIG. 3, color printhead assembly 22 is structured and adapted for mating engagement with color printhead interface assembly 146A. Color printhead assembly 22 includes a color printhead unit 156 and a plurality of detachable ink reservoirs 158. Color printhead unit 156 includes a base 160, a rear wall 161, a mounting wall 162, a pair of side walls 163 and an extension member 164. Mounting wall 162 has a first end portion 166, a second end portion 168 and a face surface 170.

Base 160 and side walls 163 extends substantially perpendicularly away from mounting wall 162 to define, in part, a housing 172 for receiving detachable ink reservoirs 158. Base 160 also has a distal end 174 near which rear wall 161 is located. Distal end 174 and rear wall 161 extend across the width of base 160 to define a latching lip surface 176.

As shown in FIG. 3, preferably, base 160 further includes a pair of V-shaped bearings 178A, 178B which are attached to a bottom surface 180 of base 160 near distal end 174, and are spaced apart along a center line 182. V-shaped bearings 178A, 178B include a plurality of bearing members 184A, 184B and 184C, 184D, respectively. Bearing members 184A, 184B, 184C, and 184D define a corresponding plurality of bearing surfaces 186A, 186B, 186C, and 186D for contacting surface 19 of guide rod 18. Accordingly, V-shaped bearings 178A, 178B define at least four points of contact with surface 19 of guide rod 18, with bearing surfaces 186A, 186C located on one side of centerline 182. Centerline 182 represents a location in space which is equidistant from bearing surfaces 186A, 186B, 186C, 186D at its closest point associated with the respective bearing surface. A plane extending perpendicularly downward from bottom surface 180 which passes through centerline 182 would also pass through the center region of guide rod 18. Thus, bearing surfaces 186A, 186B and bearing surfaces 186C, 186D are arranged and located to permit relatively unrestricted movement of color printhead assembly 22 in a direction corresponding to the extent of centerline 182, while restricting movement of color printhead assembly 22 in directions normal to centerline 182 within the downward extent of bearing members 184A, 184B, 184C, 184D.

Alternatively, each of bearing members pairs 184A, 184B and 184C, 184D could be combined and/or located to effectively form a single V-shaped bearing structure. Also, in some applications it may be desired to use a single bearing, such as V-shaped bearing 178A, which is centrally located on base surface 180 along center line 182. Also, alternatively, in some applications it may be desirable to only use a single bearing surface, or a spaced apart pair of single bearing surfaces, to contact surface 19 of guise rod 18 at one or two locations, respectively.

Mounting wall 162 includes a pair of alignment apertures 188, 190 which extend inwardly from face surface 170. Preferably, alignment aperture 188 is a circular hole and alignment aperture 190 is a tapered slotted hole. Alignment aperture 188 and alignment aperture 190 are sized and positioned for mating engagement with alignment bosses 152A, 154A, respectively, of color card assembly 32. Alignment aperture 190 is slotted to aid in the initial engagement with boss 154A.

A printhead extension 192 extends generally perpendicularly from the furthermost region of portion 168 of mounting wall 162 toward centerline 182. On printhead extension 192 is mounted a plurality of color printheads 194, each having a plurality of ink emitting nozzles. Attached to mounting wall 162 and wrapping around to printhead extension 192 is a plurality of color tape automated bonding (TAB) circuits 196 having electrical contact pads 198 arranged for corresponding engagement with spring loaded pin conductors 147A of color printhead interface assembly 146A. TAB circuits 196 include conductor paths (not shown) which are in electrical communication with corresponding ink emitting actuators associated with the plurality of ink emitting nozzles of printheads 194.

Extension member 164 extends substantially perpendicularly away from face surface 170 at first end portion 166 in a direction opposite to the extent of base 160. A bearing protrusion 200 extends perpendicularly downward from extension 164 to define a bearing surface 202. Preferably, bearing surface 202 is a single bearing surface which is curved to minimize the area of contact between bearing surface 202 and surface 17 of guide rod 16. Also, it is contemplated that the general bearing structure of bearing surface 202 could be modified to form one or more V-shaped bearing surfaces similar to that of bearings 178A, 178B.

In a preferred construction of color printhead unit 156, bearings 178A, 178B and 200 are formed from an abrasion resistant plastic having a low coefficient of friction. In fabricating color printhead 156, the combination of base 160, mounting wall 162, side walls 163 and extension member 164 form an aluminum frame to which plastic bearings 178A, 178B and 200 are molded. Alternatively, the entire color printhead unit 156 could be made of plastic and fabricated by an injection molding process.

Figure 4:
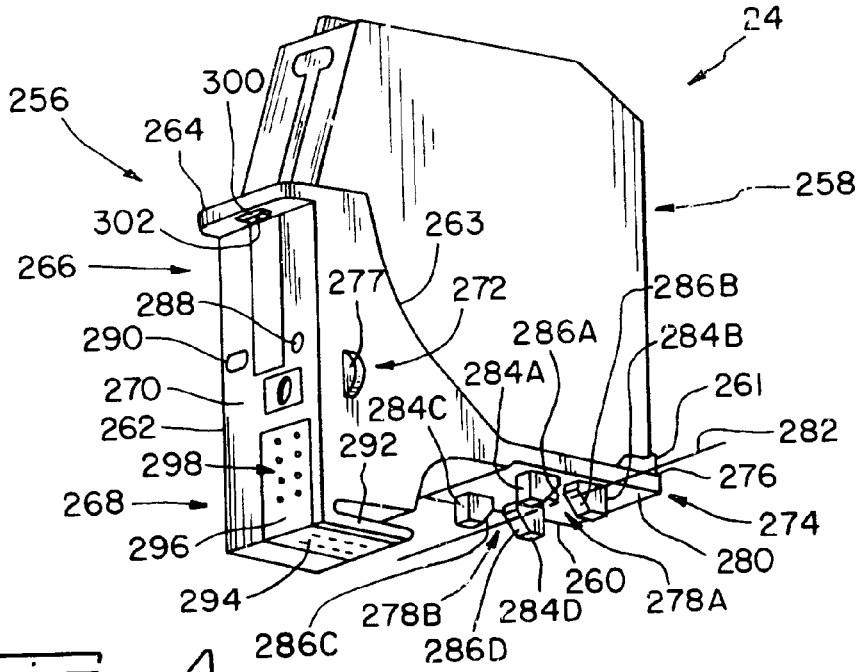
FIG. 4 is a perspective view of a mono printhead assembly of the present invention.

Referring now to FIG. 4, mono printhead assembly 24 is structured and adapted for mating engagement with mono printhead interface assembly 146B. Mono printhead assembly 24 includes a mono printhead unit 256 and a detachable mono ink reservoir 258. Mono printhead unit 256 includes a base 260, a rear wall 261, a mounting wall 262, a pair of side walls 263 and an extension member 264. Mounting wall 262 has a first end portion 266, a second end portion 268 and a face surface 270.

Base 260 and side walls 263 extend substantially perpendicularly away from mounting wall 262 to define, in part, a housing 272 for receiving detachable mono ink reservoir 258. Base 260 also has a distal end 274 near which rear wall 261 is located. Distal end 274 and rear wall 261 extend across the width of base 260 to define a latching lip surface 276. Extending outwardly from the side wall 263 which will be positioned closest to color printhead unit 156 is a spacer member 277.

As shown in FIG. 4, preferably, base 260 further includes a pair of V-shaped bearings 278A, 278B which are attached to a bottom surface 280 of base 260 near distal end 274, and are spaced apart along center line 282. V-shaped bearings 278A, 278B are formed by a plurality of bearing members 284A, 284B and 284C, 284D, respectively. Bearing members 284A, 284B, 284C, and 284D define a corresponding plurality of bearing surfaces 286A, 286B, 286C, and 286D for contacting surface 19 of guide rod 18. Thus, bearing surfaces 286A, 286B are arranged and located to form a V-shaped bearing surface of bearing 278A. Likewise, bearing surfaces 286C, 286D are arranged and located to form a V-shaped bearing surface of bearing 278B. Accordingly, V-shaped bearings 278A, 278B define at least four points of contact with surface 19 of guide rod 18, with bearing surfaces 286A, 286C located on one side of centerline 282 and with bearing surfaces 286B, 286D located on an opposing side of centerline 282. Centerline 282 represents a location in space which is equidistant from bearing surfaces 286A, 286B, 286C, 286D at its closest point associated with the respective bearing surface. A plane extending perpendicularly downward from bottom surface 280 which passes through centerline 282 would also pass through the center region of guide rod 18. Thus, bearing surfaces 286A, 286B and bearing surfaces 286C, 286D are arranged and located to permit relatively unrestricted movement of mono printhead assembly 24 in a direction corresponding to the extent of centerline 282, while restricting movement of mono printhead assembly 24 in directions normal to centerline 282 within the downward extent of bearing members 284A, 284B, 284C, 284D.

Alternatively, each of bearing member pairs 284A, 284B and 284C, 284D could be combined and/or located to effectively form a single V-shaped bearing structure. Also, in some applications it may be desired to use a single bearing, such as V-shaped bearing 278A, which could be centrally located on base surface 280 with respect to center line 282. Alternatively, in some applications it may be desirable to only use a single bearing surface, or a spaced apart pair of single bearing surfaces, to contact guide rod 18.

Mounting wall 262 includes a pair of alignment apertures 288, 290 which extend inwardly from face surface 270. Preferably, alignment aperture 288 is a circular hole and alignment aperture 290 is a tapered slotted hole. Alignment aperture 288 and alignment aperture 290 are sized and positioned for mating engagement with alignment bosses 152B, 154B of mono card assembly 33. Alignment aperture 290 is slotted to aid in the initial engagement with boss 154B.

A printhead extension 292 extends generally perpendicularly from mounting wall 292. On printhead extension 292 is mounted a mono printhead 294 having a plurality of ink emitting nozzles. Attached to mounting wall 262 and wrapping around a printhead extension 292 is a mono TAB circuit 296 having electrical contact pads 298 arranged for corresponding engagement with spring loaded pin conductors 147B of mono printhead interface assembly 146B. TAB circuit 296 includes conductor paths (not shown) which are in electrical communication with corresponding ink emitting actuators associated with the plurality of ink emitting nozzles of printhead 294.

Extension member 264 extends substantially perpendicularly away from face surface 270 at first end portion 266 in a direction opposite to the extent of base 260. A bearing protrusion 300 extends perpendicularly from extension 164 to define a bearing surface 302. Preferably, bearing surface 302 is a single bearing surface which is curved to minimize the area of contact between bearing surface 302 and surface 17 of guide rod 16. In some applications, it may be desirable to use a plurality of single bearing surfaces, such as a spaced pair of single bearing surfaces, to contact surface 17 of guide rod 16. Also, it is contemplated that the general bearing structure of bearing surface 302 could be modified to form one or more V-shaped bearing surfaces, such as that represented by V-shaped bearings 278A,278B.

In a preferred construction of mono printhead unit 256, bearings 278A,278B and 300 are formed from an abrasion resistant plastic having a low coefficient of friction. In fabricating mono printhead 256, the combination of base 260, mounting wall 262, side walls 263 and extension member 264 form an aluminum frame to which plastic bearings 178A, 278B and 300 are molded. Alternatively, the entire mono printhead unit 256 could be made of plastic and fabricated by an injection molding process.

Referring to FIGS. 2 and 5, latch mechanism 30 is structured and arranged to be movable between a non-latched position (as depicted in FIG. 2) and a latched position (as depicted in FIG. 5).

When latch mechanism 30 is positioned in the non-latched position, carrier assembly 20 is supported by surface 17 of guide rod 16 at the portion of carrier assembly 20 which surrounds passage 50. Also, surface 19 of guide rod 18 supports a portion of carrier assembly 20 located near recessed region 102. While in the non-latched position, color printhead assembly 22 and/or mono printhead assembly 24 can be removed or installed. Assuming an initial condition in which no printhead assembly is installed on carrier assembly 20, while in the non-latched position the user inserts color printhead assembly 22 and mono printhead assembly 24 into color receptacle 34 and mono receptacle 36, respectively, of carrier 20.

Latching mechanism 30 is structured and arranged to facilitate an over-center latching to effectively mount carrier assembly 20 to color printhead unit 156 of color printhead assembly 22. Mono printhead assembly 24 is effectively mounted to carrier assembly 20 via inner frame 48 such that mono printhead assembly 24 follows guide rods 16, 18 independent of color printhead assembly 22. During latching, color printhead assembly 22 and mono printhead assembly 24 will engage color printhead interface assembly 146A with mono printhead interface assembly 146B, respectively, of carrier assembly 20. When latch mechanism 30 is moved to the latched position, as shown in FIG. 5, carrier assembly 20 is lifted to be positioned out of contact with first guide rod 16 and seconded guide rod 18, and carrier assembly 20 is supported in relation to guide rods 16, 18 by color printhead assembly 22, with the entire unit (i.e. carrier assembly 20, color printhead assembly 22, and mono printhead assembly 24) positioned relative to guide rods 16 and 18 by color printhead bearings 178A, 178B and 200 of color printhead assembly 22 and mono printhead bearings 278A, 278B and 300 of mono printhead assembly 24 (see FIG. 3).

Referring again to FIG. 2, during latching handle 110 is rotated forward in the direction depicted by arrows 304A, 304B until first and second distal ends 122, 124 of handle 110 engage pivot slots 66, 86, respectively. During this rotation, several actions occur substantially simultaneously. As latching portions 140A, 140B of bails 112, 114 contact rear wall 161 and latching lip surface 176 of color printhead assembly 22, and rear wall 261 and latching lip surface 276 of mono printhead assembly 24, respectively, carrier assembly 20 begins to move toward printhead assemblies 22, 24. As this movement occurs, color alignment bosses 152A, 154A and mono alignment bosses 152B, 154B engage alignment apertures 188, 190 of color printhead unit 156 and alignment apertures 288, 290 of mono printhead unit 256, respectively. This in turn lifts the front portion of carrier assembly 20 to provide clearance between guide rod 16 and carrier 20 at passage 50.

As handle 110 is then rotated downward in the direction of arrow 306, the color bail 112 and mono bail 114 continue their movement to their final position, as shown in FIG. 5. During this downward rotation, an over-centering event occurs. This over-centering lifts the back end of carrier 20 so as to provide clearance between the recessed portion 102 of carrier 20 and surface 19 of guide rod 18. Since the interface assemblies 146A, 146B apply a force which opposes the force applied by the latching portions 140A, 140B through printhead assemblies 22, 24, secure mating of carrier 20 to printhead assemblies 22, 24 occurs. Carrier stop members 64A, 64B and 96A, 96B of carrier assembly 20 limit the amount that carrier assembly 20 may rotate toward color printhead assembly 22 and mono printhead assembly 24, respectively. Simultaneously, guide members 133A, 133B of handle 110 engage the respective guide slots of body 28. Also, in turn, this motion rotates door 82 towards springs 84 to apply a force against mono printhead assembly 24, which in turn causes spacer member 277 of mono printhead assembly 24 to contact an adjacent side wall 163 of color printhead assembly 22, which in turn biases color printhead assembly 22 against spacing boss 65 located on side wall 42 of carrier body 28. Thus, once the latching process is completed, color printhead assembly 22 and mono printhead assembly 24 are properly aligned with carrier assembly 20 for printing.

In order to assure proper alignment of printhead assemblies 22, 24 with corresponding interface assemblies 146A, 146B, color card assembly 32 and mono card assembly 33 are attached to carrier assembly 20 in the manner described below. Color printhead interface assembly 146A is attached to color circuit card 144A at a predetermined location such that alignment bosses 152A, 154A are in proper orientation with respect to locator pins 148, 150. Color card assembly 32 is then inserted into receptacle 34 and positioned to be adjacent front wall 38. In addition, color card assembly 32 is positioned adjacent to side wall 42, such that locator pins 148, 150 engage corresponding locator indentions 70, 71, respectively. Once color card assembly 32 is properly positioned with respect to side wall 42, color card assembly 32 is mounted to front wall 38 using fasteners, such as for example, screws. Thereafter, mono card assembly 33 is positioned relative to color card assembly 32, and mounted to front wall 38 using fasteners.

During printing, carrier assembly 20 is moved in a reciprocating manner in relation to guide rods 16, 18 by forces exerted by a carrier drive unit (not shown) via drive belt 26. However, carrier assembly 20 does not contact guide rods 16, 18. Rather, bearings positioned on printhead assemblies 22, 24 contact guide rods 16, 18.

While this invention has been described as having a preferred design, the present invention can be further modified within the spirit and scope of this disclosure. This application is therefore intended to cover any variations, uses, or adaptations of this invention using its general principles. Further, this application is intended to cover such departures from the present disclosure as come within known or customary practice in the art to which this invention pertains and which fall within the limits of the appended claims.

What is claimed is:

1. An imaging apparatus, comprising:

a first side frame;

a second side frame;

a first guide rod extending between said first side frame and said second side frame, said first guide rod having a first surface and a first cross-sectional area;

a second guide rod extending between said first side frame and said second side frame and arranged parallel to said first guide rod, said second guide rod having a second surface and a second cross-sectional area;

a carrier assembly having a body and having a printhead interface unit attached to said body and a printhead unit structured and adapted for mating engagement said printhead interface unit, said printhead unit having at least one bearing surface which contacts said first surface of said first guide rod and at least one second bearing surface which contacts said second surface of said second guide rod.

2. The imaging apparatus of claim 1, wherein said body has a passage which receives said first guide, said passage having a cross-sectional area which is larger than said first cross-sectional area, and wherein said carrier assembly further comprises a latch mechanism coupled to said body, said latch mechanism being movable between a non-latched position and a latched position, wherein said latch mechanism is structured and arranged so that when said latch mechanism is positioned in said latched position, said carrier assembly is moved to be positioned out of contact with said first guide rod and said second guide rod.

3. The imaging apparatus of claim 1, wherein said carrier assembly further comprises a latch mechanism coupled to said body, said latch mechanism being movable between a non-latched position and a latched position, wherein said latch mechanism is structured and arranged so that when said latch mechanism is positioned in said latched position, said carrier assembly is moved to be positioned out of contact with said first guide rod and said second guide rod.

4. The imaging apparatus of claim 3, wherein said latch mechanism is structured and arranged so that when said latch mechanism is positioned in said non-latched position, said carrier assembly is supported by said first surface of said first guide rod and by said second surface of said second guide rod.

5. The imaging apparatus of claim 1, further comprising a latching mechanism structured and arranged for pivotal mounting to said body.

6. The imaging apparatus of claim 1, wherein said body includes a first wall, a second wall, a third wall, a fourth wall, a first extension portion and a second extension portion, said first wall having a first wall portion having a first axle hole formed therein, said second wall having a second side wall portion having a second axle hole formed therein, said first extension portion including a first pivot slot and said second extension portion including a second pivot slot.

7. The imaging apparatus of claim 6, further comprising a latching mechanism including a handle having substantially a U-shape defined by a first member and a second member which are spaced apart and extend in parallel from a bridge member, said first member having a first distal end for engaging said first pivot slot of said body and said second member having a second distal end for engaging said second pivot slot of said body.

8. The imaging apparatus of claim 7, wherein said first member includes a first mid-portion having a first pivot hole formed therein, said latching member further comprising a first bail having a first axle portion, a second axle portion, a first lever portion, and a first latching protion, said first axle portion being spaced apart and coaxial with said second axle portion along a first axis and said first latching portion being formed between and extending outwardly away from said first axle portion and said second axle portion, said first axle portion being positioned in said first axle hole of said body and said second axle portion being positioned in said second axle hole of said body, and wherein said first lever portion extends outwardly away from said axis, said first lever portion having a first extended end defining a first pivot portion which is positioned in said first pivot hole of said handle.

9. The imaging apparatus of claim 8, wherein a first extent of said first lever portion of said first bail from said axis is greater than a second extent of said first latching portion of said first bail from said axis.

10. The imaging apparatus of claim 1, wherein said printhead unit comprises:

a mounting wall having a first end portion, a second end portion and a face surface;

a first member extending outwardly from said face surface at said first end portion of said mounting wall, said first member including said first bearing surface; and a base including said second bearing surface.

11. The imaging apparatus of claim 10, wherein said first bearing surface is defined by at least one bearing protrusion extending outwardly from said first member.

12. The imaging apparatus of claim 10, wherein said second bearing surface is defined by at least one of a first plurality of bearing members.

13. The imaging apparatus of claim 1, wherein said second bearing surface corresponds to a V-bearing surface of a V-shaped bearing.

14. The imaging apparatus of claim 1, wherein said body includes a plurality of V-shaped bearings, wherein said second bearing surface corresponds to at least one bearing surface of said plurality of V-shaped bearings and wherein each of said plurality of V-shaped bearings defines at least two bearing surfaces which contact said second surface of said second guide rod.

15. The imaging apparatus of claim 14, wherein said plurality of V-shaped bearings defines at least four bearing surfaces which contact with said second surface of said second guide rod.

16. The imaging apparatus of claim 1, wherein said printhead unit includes a mounting wall having at least one alignment aperture formed therein.

17. The imaging apparatus of claim 16, wherein said printhead interface unit includes at least one alignment boss, each said at least one alignment boss being positioned for mating engagement with a corresponding one of said at least one alignment aperture.

18. The imaging apparatus of claim 1, wherein said body includes a first wall, a second wall, a third wall, a fourth wall, said first wall having a first carrier stop member extending toward said third wall, wherein said first carrier stop member limits an extent of engagement of said carrier assembly with said printhead unit.

19. The imaging apparatus of claim 1, further comprising a circuit card which mounts said printhead interface unit to said body, said body defining a printhead receptacle having a first wall, said first wall including at least two indexing indentions, said circuit card including a corresponding at least two alignment pins structured and arranged for mating engagement with said at least two indexing indentions.

20. An imaging apparatus, comprising:

a first side frame;

a second side frame;

a first guide rod extending between said first side frame and said second side frame, said first guide rod having a first surface and a first cross-sectional area;

a second guide rod extending between said first side frame and said second side frame and arranged parallel to said first guide rod, said second guide rod having a second surface and a second cross-sectional area;

a carrier assembly having a body and having a color printhead interface unit attached to said body;

a color printhead unit structured and arranged for mating engagement with said color printhead interface unit, said color printhead unit having a first bearing surface which contacts said first surface of said first guide rod and a first pair of V-shaped bearings defining four bearing surfaces which contact said second guide surface of said second guide rod.

21. The imaging apparatus of claim 20, further comprising:

a mono printhead interface unit attached to said body; and a mono printhead unit structured and arranged for mating engagement said mono printhead interface unit, said mono printhead unit having a second bearing surface which contacts said first surface of said first guide rod and a second pair of V-shaped bearings defining four bearing surfaces which contact said second guide surface of said second guide rod.

22. The imaging apparatus of claim 21, wherein said carrier assembly further comprises a latch mechanism pivotally coupled to said body, said latch mechanism being movable between a non-latched position and a latched position, wherein said latch mechanism is structured and arranged so that when said latch mechanism is positioned in said latched position, said carrier assembly is moved to be positioned out of contact with said first guide rod and said second guide rod.

23. The imaging apparatus of claim 22, wherein said latch mechanism is structured and arranged so that when said latch mechanism is positioned in said non-latched position, said carrier assembly is supported by said first surface of said first guide rod and by said second surface of said second guide rod.

24. A printhead unit for an imaging apparatus having a guide member, comprising:

a housing having at least a first side member;

a printhead attached at least to said first side member of said housing; and at least one bearing having at least one bearing surface, said bearing coupled to said first side member of said housing and positioned to engage said guide member.

25. The printhead unit of claim 24, wherein said at least one bearing surface has a curved shape.

26. The printhead unit of claim 24, wherein said at least one bearing includes a plurality of bearing surfaces for engaging said guide member.

27. The printhead unit of claim 26, wherein said plurality of bearing surfaces defines at least two bearing surfaces arranged in a V-shaped configuration.

28. The printhead unit of claim 26, wherein said plurality of bearing surfaces defines at least four bearing surfaces.

29. The printhead unit of claim 28, wherein said four bearing surfaces are arranged to form two V-shaped bearing configurations.

30. The printhead unit of claim 24, wherein said first side member is one of a base and a wall.

31. A printhead unit for an imaging apparatus having a first guide member and a second guide member comprising:

a housing having at least a first side member and a second side member;

a printhead attached to said housing;

a first bearing having a first bearing surface, said first bearing being coupled to said first side member of said housing and positioned to engage said first guide member; and a second bearing having a second bearing surface, said second bearing being coupled to said second side member of said housing and positioned to engage said second guide member.

32. The printhead unit of claim 31, wherein said first bearing surface has a curved shape.

33. The printhead unit of claim 31, wherein said second bearing includes a third bearing surface for engaging said second guide member.

34. The printhead unit of claim 33, wherein said second bearing surface and said third bearing surface are arranged in a V-shaped configuration.

35. The printhead unit of claim 33, further comprising a third bearing having a fourth bearing surface and a fifth bearing surface, wherein said second bearing surface and said third bearing surface are arranged in a first V-shaped configuration and wherein said fourth bearing surface and said fifth bearing surface are arranged in a second V-shaped configuration.

36. The printhead unit of claim 31, wherein said first side member is a base and second side member is a wall.

* * * * *